US005811924A

United States Patent [19]

Okumura et al.

[11] Patent Number: 5,811,924

[45] Date of Patent: Sep. 22, 1998

[54] FLUORESCENT LAMP

[75] Inventors: Miwa Okumura, Kawasaki; Naotoshi Matsuda, Tokyo; Keiko Albessard, Yokohama; Masaaki Tamatani, Fujisawa; Fusayoshi Kido, Yokohama; Iwao Mitsuishi, Tokyo, all of Japan

[73] Assignee: Kabushiki Kaisha Toshiba, Kawasaki, Japan

[21] Appl. No.: 715,478

[22] Filed: Sep. 18, 1996

[30] Foreign Application Priority Data

| | | | |
|---|---|---|---|
| Sep. 19, 1995 | [JP] | Japan | 7-263638 |
| Sep. 27, 1995 | [JP] | Japan | 7-248205 |
| Sep. 28, 1995 | [JP] | Japan | 7-251331 |
| Sep. 28, 1995 | [JP] | Japan | 7-251332 |

[51] Int. Cl.[6] ..... H01J 63/04

[52] U.S. Cl. ..... 313/487; 313/467

[58] Field of Search ..... 313/485, 486, 313/489, 487, 461, 467

[56] References Cited

U.S. PATENT DOCUMENTS

| | | | |
|---|---|---|---|
| 4,825,124 | 4/1989 | Sigai | 313/489 |
| 4,950,948 | 8/1990 | Peters et al. | 313/485 |
| 4,999,219 | 3/1991 | Kilnedist et al. | 313/486 |
| 5,644,193 | 7/1997 | Matsuda et al. | 313/486 |

FOREIGN PATENT DOCUMENTS

| | | |
|---|---|---|
| 61-27055 | 2/1986 | Japan . |
| 2-74400 | 3/1990 | Japan . |
| 4-50280 | 2/1992 | Japan . |

OTHER PUBLICATIONS

Technical Digest of Phosphor Research Society, No. 255, p. 3, 1996 no month, Y. Murayama, "The Phosphors of Luminous Paints".

Phosphor Research Society, Phosphor Handbook, pp. 348–351, Dec. 25, 1987.

IEEE Transactions on Electron Devices, vol. ED–33, No. 8, pp. 1128–1131, Aug. 1986, Rodney W. Young, et al., "A Transparent Thin–Film CRT Screen of $Y_2O_3$: Eu with Contrast–Enhancement Layer".

*Primary Examiner*—Max H. Noori

*Attorney, Agent, or Firm*—Oblon, Spivak, McClelland, Maier & Neustadt, P.C.

[57] ABSTRACT

A phosphor film structure comprising a substrate and a phosphor film formed on the substrate, wherein the phosphor film comprises ultrafine phosphor particles having an average diameter of 200 nm or less, and obtained by heating a phosphor material to vaporize and rapidly quenching to solidify, and a haze of the phosphor film to a luminous flux of 380–760 nm in wavelength is 50% or less.

14 Claims, 6 Drawing Sheets

FLUORESCENT LAMP

BACKGROUND OF THE INVENTION

1. Field of the Invention

The present invention relates to a phosphor film structure using inorganic fine phosphor particles, and particularly to a phosphor film structure having a high transparency to visible light.

2. Description of the Related Art

The phosphor film structure using inorganic fine phosphor particles has been widely used in, for example, cathode ray tubes, X-ray image multiplier tubes, EL elements, fluorescent lamps, luminous panels and the like.

In the cathode ray tubes, use is made of a phosphor film structure which is mode by dispersing phosphor particles having diameters in the order of several $\mu$m in a high molecular weight solvent and then by coating the resultant suspension onto a substrate such as a glass plate. However, the phosphor film used in such a conventional phosphor film structure is formed of large phosphor particles, so that the transparency to visible light is low, which means that visible light is scattered by phosphor particles in high degree. Accordingly, such large phosphor particles are not suitable for uses requiring a high resolution.

Now, using a cathode luminescence thin film in a phosphor film structure, which can provide a high radiation intensity and a high resolution without causing scattered reflection, cathode ray tubes providing a high resolution image have been studied (for example, Bodney W. Young et al., IEEE TRANSACTIONS ON ELECTRON DEVICES, Vol. ed.-33, NO. 8 (1989)). The cathode luminescence thin film is formed by depositing phosphors on a glass plate by sputtering and then annealing to improve the crystallizability of the film.

As another type of a device using the phosphor film structure, known is a thin-film type EL luminescence element. The device has a laminate structure comprising a surface electrode, an insulating layer, a phosphor thin film, an insulating layer, and a back electrode superimposed one upon another on a glass substrate in the order mentioned. The phosphor thin film used herein is formed by sputtering or deposition.

However, the phosphor film structures using the cathode luminescence thin film and the EL thin film mentioned above have the following problems.

A first problem is that a film formation efficiency is low. The cathode luminescence thin film and the EL thin film are formed by deposition and sputtering as mentioned above, in accordance with the PVD (physical vapor deposition) method or the CVD (chemical vapor deposition) method. In these thin film formation methods, the film is grown at a low speed. It therefore takes a long time to obtain a phosphor film having a sufficient thickness suitable for use in the phosphor film structure such as a cathode ray tube. In these methods, it is difficult to form a large-size phosphor film. The low film-formation efficiency will be a problem also in the field of EL elements, since development has been recently performed toward large-scale EL elements.

A second problem is in film crystallizability. The luminescence efficiency of the phosphor film is related to the film crystallizability. It is known that as the film crystallizability is improved, the luminescence efficiency increases. However, the phosphor film obtained immediately after the low temperature deposition near room temperature exhibits a poor crystallizability due to a low temperature synthesis, thus inevitably accompanying various defects. To improve the film crystallizability, annealing treatment is usually applied. The effect produced by annealing is strongly correlated to temperature. If the annealing temperature is not sufficiently high, the crystallizability will not be improved efficiently. In fact, after films were formed from $Y_2O_3$:Eu by sputtering, the films were annealed at, for example, 400° C. and 1,000° C., respectively and compared by X-ray diffraction. As a result, the film annealed at 1,000° C. presented a narrower diffraction width, demonstrating a good crystallizability and a high luminescence efficiency.

However, when a phosphor film is annealed at a high temperature, a substrate supporting the phosphor film is inevitably exposed to the high temperature. To anneal the phosphor film, for example, at 1000° C., a high temperature resistant material such as sapphire or quartz glass must be used. However, since sapphire and quartz glass are uncommon and expensive materials, a manufacturing cost will be significantly increased. Furthermore, the high temperature annealing treatment itself is complicated and requires much labor, compared to the low temperature annealing.

SUMMARY OF THE INVENTION

A first object of the present invention is to provide a novel phosphor film structure with a high brightness and a high transparency to visible light and capable of being manufactured simply at a low cost.

A second object of the present invention is to provide a fluorescent lamp, ultraviolet-ray suppressed luminescent source, luminous panel, and transparent luminous base material, which utilize the novel phosphor film structure.

The first object can be achieved by a phosphor film structure comprising a substrate and a phosphor film formed on the substrate, wherein the phosphor film comprises ultrafine phosphor particles having an average diameter of 200 nm or less, and obtained by heating a phosphor material to vaporize and rapidly quenching to solidify; and a haze of the phosphor film to a luminous flux of 380–760 nm in wavelength is 50% or less.

The fluorescent lamp as a first applied embodiment of the phosphor film structure comprises:

a glass tube in which an ionized medium containing mercury is sealed;

an undercoat layer formed on the inner surface of the glass tube;

a luminous layer containing phosphor particles, formed on the undercoat layer; and electrodes provided on both ends of the glass tube, wherein the undercoat layer is made of ultrafine phosphor particles having an average diameter of 200 nm or less which are obtained by heating the phosphor material to vaporize and then rapidly quenching to solidify.

The ultraviolet-suppressed light source as a second applied embodiment of the present invention comprises:

a lamp device formed of a glass tube in which elements required for a light emission are incorporated; and an ultraviolet-suppressing layer formed on the outer surface of the glass tube, wherein the ultraviolet suppressing layer contains ultrafine phosphor particles having an average diameter of 200 nm or less which are obtained by heating a phosphor material to vaporize and then rapidly quenching to solidify.

The luminous panel as a third applied embodiment of the present invention comprises, a substrate and a luminous layer formed on the substrate, wherein the luminous layer is formed of ultrafine phosphor particles having an average diameter of 200 nm or less which are obtained by heating a long persistent inorganic phosphor material to vaporize and then rapidly quenching to solidify.

The transparent luminous material as a forth applied embodiment comprises a transparent matrix substance and luminous particles dispersed in the substance, wherein the luminous particles are ultrafine phosphor particles having an average diameter of 200 nm or less which are obtained by heating a long persistent inorganic phosphor material to vaporize and then rapidly quenching to solidify.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate presently preferred embodiments of the invention and, together with the general description given above and the detailed description of the preferred embodiments given below, serve to explain the principles of the invention.

DETAILED DESCRIPTION OF THE PREFERRED EMBODIMENT

Figure 1:
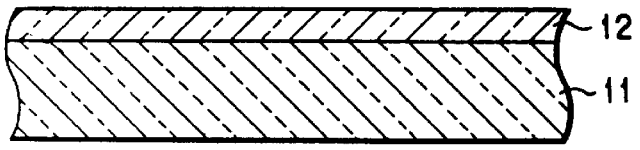
FIG. 1 is a cross sectional view showing a phosphor film structure of the present invention.

Hereinbelow, the present invention will be described in detail.

In the present invention, the "phosphor material" refers to any one of a previously-prepared phosphor having a desired composition, a composition having the same atomic composition as the desired phosphor, and a composition capable of forming a desired phosphor by reaction. The composition of the phosphor material is not particularly restricted and can be appropriately chosen depending on its specific usages.

Particularly to specify, compounds represented by the following formulas are preferred to be used:

$$(Ln_{1-x}R_x)_2O_3$$

$$(Ln_{1-x}R_x)_2O_2S$$

where Ln is Y, Gd or La; R is Pr, Eu or Tb; and $0 \leqq x \leqq 0.5$

In addition, a compound mainly made of $CaWO_4$ or ZnS is preferable.

The term "haze" used in the present invention is used in the sense defined in the JIS (Japan Industrial Standard). The "haze" is a value expressing a ratio of a diffuse transmission light amount relative to a total transmission light amount in terms of percentage. The diffuse transmission light amount used herein is an amount obtained by subtracting a regular transmission light amount from the total transmission light amount. More specifically, the state of "haze 0%" is one having no light diffusion, that is, a state free from a haze. Conversely, the state of "haze 100%" is one in which transmission light is completely diffused, that is, a state of a complete haze.

The "ultrafine phosphor particles" in the present invention are those having an average particle diameter of 200 nm or less, preferably 100 nm or less and a haze of 50% or less. If the average particle diameter exceeds 200 nm, visible light (380–760 nm in wavelength) will be scattered in higher degree. Therefore, the phosphor film formed of such phosphor particles will probably have a haze in excess of 50%. If the phosphor film with a haze of 50% or more is used to form the phosphor screen of a cathode ray tube, a higher resolution than those of the cathode ray tubes presently used will not be obtained. Consequently, it is impossible to obtain advantages of the present invention. On the other hand, in the case where the ratio of the ultrafine phosphor particles having diameters larger than 200 nm is high although the average particle diameter falls within the range of 200 nm or less, visible light will be scattered and liable to cause a haze in excess of 50%. For the reasons mentioned above, the ratio of particles having diameters larger than 300 nm is preferably 5% (by particle number) or less, more preferably 1% or less. In general, the size distribution pattern of the ultrafine phosphor particles of the present invention follows a normal distribution. If the percentages of the particles having diameters of 300 nm or more are determined in addition to the average diameter thereof, the particle size distribution can be specified. In this sense, the size distribution pattern of phosphor particles is incorporated in the concept the "ultrafine phosphor particles" of the present invention.

On the other hand, it is difficult to manufacture and to handle the ultrafine phosphor particles having an average diameter less than 1 nm. In addition, the luminescent efficiency thereof will be probably low. Hence, the more preferable average diameter is from 10 to 100 nm.

The ultrafine phosphor particles mentioned above can be prepared by heating any one of a phosphor having desired composition previously-prepared, a composition having the same atomic composition as the desired phosphor, and a composition capable of forming a desired phosphor by reaction, to a boiling point or a sublimation point or more to vaporize them and then rapidly quenching to solidify. Such preparation methods include a method in which a composition is vaporized in gas by a high frequency thermal plasma process or a direct current plasma process and then quenched to aggregate; and a plasma spray method. To describe the preparation method more specifically, a phosphor material is supplied into a high temperature thermal plasma together with a career gas, retained for a short time, taken out of the thermal plasma and then rapidly quenched. The term "thermal plasma" used herein refers to a high temperature ionized state of gas. The thermal plasma can be generated by the application of a high frequency electromagnetic wave of several megahertz to several tens of megahertz or by the application of a direct current discharge. In the thermal plasma, the gas temperature of the so called torch portion or flame portion reaches to several thousand to ten thousand degrees of Centigrade. The high frequency thermal plasma apparatus is detailed in Yoshida et al., Iron and Steel: 68(10), p 20 (1982). The fine phosphor particles prepared by these methods have sufficient brightness even if heat annealing is not performed additionally, and almost fall within the size distribution range of 10 to 200 nm. Besides these, the fine phosphor particles are stable to electron beam, infrared and ultraviolet radiations and cause no significant changes in emission colors. Incidentally, even by the conventional method in which large-size phosphor particles are broken into pieces, the ultrafine phosphor particles of at most 200 nm in average diameter can be obtained. However, the fine particles obtained by such a mechanical breaking are not used in practice since the phosphor film obtained therefrom is low in brightness even if the transparency thereof is improved.

If the diameters of phosphors are shorter than the wavelength (380–760 nm) of visible light, visible light seldom be scattered. The ultrafine phosphor particles of the present invention have an average diameter of 200 nm or less and contain almost no phosphor particles having diameters larger than the wavelength of visible light. Therefore, if the ultrafine phosphor particles of the present invention are used, a highly transparent phosphor film can be formed. If the classification of the particles are further performed to remove large particles of at least 150 nm in diameter, the particle distribution will be rendered more sharp, with the result that the transparency to visible light and ultraviolet reflection properties can be further improved.

Hereinbelow, the phosphor film structure of the present invention will be described in more detail with reference to accompanying drawings. The phosphor film structure of the present invention comprises a laminate structure in which a phosphor film 12 is formed on the surface of a substrate 11, as shown in FIG. 1. As describe previously, unlike the conventional ones, the phosphor film structure of the present invention can acquire sufficient brightness even if heat treatment such as annealing is not performed during and after the formation of the phosphor film 12. Since the heat treatment is no longer required, the material quality and the thickness of the substrate 11 are not particularly limited and may be appropriately chosen depending on usages. As the substrate 11, a transparent substrate is usually used. Examples of the substrate include a glass substrate, a plastic substrate, and the like. The shape of the substrate 11 is not particularly restricted. The shape of the substrate 11 can be appropriately chosen from a plate form, tubular form, spherical form, and the like, depending on usages. Furthermore, the substrate is not limited to a single layer structure. Use may be made of a multilayered substrate consisting of a base and at least one layer, e.g., electrically conductive coating layer, formed of a material different from that of the base.

The phosphor film 12 provided on the substrate 11 may be formed by a general film forming method. For example, the ultrafine phosphor particles of the present invention prepared as described before are classified as necessary, dispersed in an appropriate solvent. The resultant dispersion solution is then coated on the surface of the substrate 12 in accordance with a customary method. If necessary, an appropriate binder may be added. The solvent used herein is not particularly restricted as far as it can dissolve a binder. However, in consideration of drying at a low temperature, a solvent having a boiling point ranging from 80° to 200° C. is preferably used. The solvents having such characteristics include aromatic hydrocarbons such as xylene and toluene; alcohols such as n-buthanol; esters such as butyl acetate; and saturated hydrocarbons such as n-hexane, ligroin, mineral spirit. Depending on a solvent selected, drying can be carried out at room temperature to form a coating film. Examples of the coating method include dip coating, sedimentation, spin coating, spraying, coating, and various printing techniques such as heat transfer printing, screen printing, flexography, and gravure printing. These methods are easily applicable to large area coating, using conventional facilities as they are without extra facilities. Hence, the coating can be performed at a low cost. Incidentally, since the viscosity required for the coating solution differs depending on a coating method to be employed, it must control viscosity to a desired value by varying the amounts of a solvent and a binder.

Figure 2:
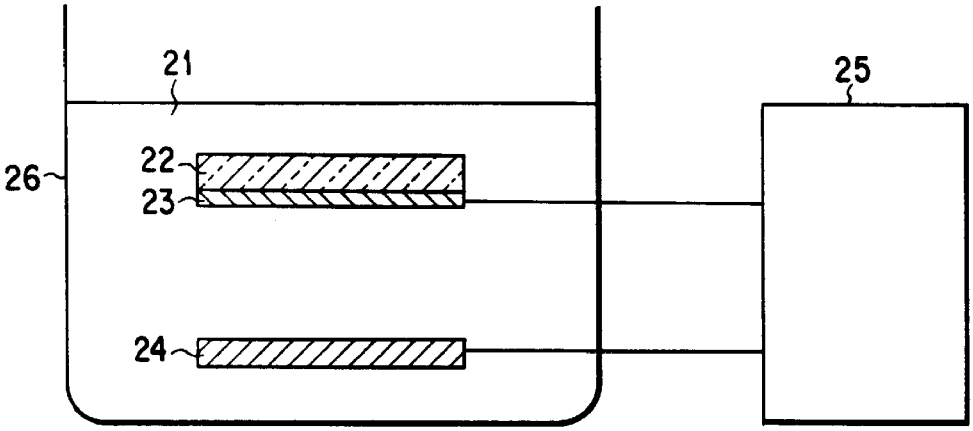
FIG. 2 is a view for use in explaining a method of forming a phosphor film on a substrate by an electron deposition method.

As a method of forming a phosphor film 12, an electro-deposition method is preferably used. The electro-deposition method is widely used as a method of forming a film from powder, such as phosphors, by use of electrophoresis. FIG. 2 shows a method of forming the phosphor film 2 by use of the electro-deposition method.

In FIG. 2, reference numeral 26 is an electro-deposition vessel which is filled with a suspension 21 containing ultrafine phosphor particles dispersed therein. In the suspension 21, a glass substrate 22 and electrode 24 are soaked. On the surface of the glass substrate 22, a conductive coating film 23 made of indium-tin oxide has been formed by a customary method. The glass substrate 22 and the electrode 24 are placed in such a way that the conducting coating film 23 is opposed to the electrode 24 at a predetermined distance apart. Subsequently, the conductive coating film 23 and the electrode 24 are connected to a direct current source 25.

When voltage is applied between the conductive coating film 23 and the electrode 24, electrically-charged ultrafine phosphor particles start to migrate in the suspension 21 and are deposited on the conductive coating film 23, thereby forming a phosphor film. Since the migration distances during the electrophoresis differ depending on particle diameters, if the magnitude of voltage and its application time are controlled, a phosphor film can be formed of phosphors of a uniform size. For the same reason, even though phosphor particles in excess of 200 nm in diameter are present in the suspension, such large phosphor particles can be prevented from entering the phosphor film by controlling the electrophoresis conditions.

As described before, the ultrafine phosphor particles have extremely high transparency with almost no occurrence of visible light scattering. However, the other ingredients contaminated in the phosphor film 2 may cause scattering. Therefore, if the thickness of the phosphor film 2 is excessively large, a haze of 50% or less cannot be achieved. Hence, the thickness of the phosphor film 2 is preferably from 100 nm to 100 $\mu$m, more preferably from 1 to 3 $\mu$m.

As is explained in the foregoing, since the ultrafine phosphor particles of the present invention, that is, the ultrafine phosphor particles produced by heating a phosphor material to vaporize and rapidly quenching to solidify, have sufficient brightness, it is not necessary to apply heat treatment to the phosphor film after it is formed on a substrate, unlike the case of a conventional phosphor film. Therefore, the present invention is advantageous in that a heat treatment step can be omitted and in that an inexpensive material can be used as a substrate since the substrate material is not particularly limited. Since the average diameter of the ultrafine phosphor particles is 200 nm or less which is shorter than the wavelength of visible light, visible light is not scattered, increasing the transparency. Hence, the phosphor film structure of the present invention using such ultrafine phosphor particles can be applied to the usages requiring a high resolution such as high resolution cathode ray tubes and EL elements.

Hereinbelow, other applied embodiments of the phosphor film structure of the present invention will be described.

Fluorescent lamp

<Background>

A first applied embodiment is a fluorescent lamp. The fluorescent lamp is used not only as a general lighting source but also as a light source in a wide variety of fields, such as lights for office automation appliances, pixel lights for huge screens, and backlights for liquid crystal displays. At the place requiring the attention to color fading, particularly in department stores, art museums, and museums, in order to prevent color fading of merchandise and exhibits, a fluorescent lamp (NU lamp) which can avoid color fading has been conventionally used as a lighting source.

The fluorescent lamp emits light when phosphors are excited by ultraviolet rays due to mercury discharge. The conventional NU lamp has a laminate structure, which comprises a non-luminous undercoat layer for reflecting and/or absorbing ultraviolet rays and a phosphor film, and which are formed in the order mentioned above on the inner surface of a glass tube constituting a fluorescent tube. The undercoat layer for adsorbing ultraviolet rays is made of a particulate material such as silicate dioxide, titanium dioxide, aluminum oxide, or cerium oxide (Jpn. Pat. Appln. KOKAI Publication Nos. 63-58756, 63-58756). In the undercoat layer for reflecting ultraviolet rays, cerium oxide is used. The undercoat layer reflects or absorbs ultraviolet rays of 400 nm or less which causes color fading. If the NU lamp is used as a lighting source, the color fading of merchandise and exhibits can be prevented.

In a general fluorescent lamp using no undercoat layer, since ultraviolet rays pass through a luminous layer and directly radiate onto a glass tube, or since glass reacts with mercury, solarization of a soda glass sometime takes place. Whereas, in the NU lamp, such a solarization can be prevented by the presence of the undercoat layer.

However, the conventional NU lamp has the following drawbacks in comparison with general fluorescent lamps having no titanium dioxide film or the like.

A first drawback is that a luminous flux of the NU lamp is decreased (5 to 10%) compared to that of the generally-used lamps since the undercoat layer must be thick and the content of particulate material such as titanium dioxide must be increased in order to absorb ultraviolet rays sufficiently.

A second drawback is that the emission color of the NU lamp using titanium dioxide differs from that of the generally-used lamps, since titanium dioxide absorbs not only ultraviolet rays but also visible light of short wavelengths.

A third drawback is that heat treatment of nearly 800° C. must be performed two times to form a coating film of a double layer structure. Consequently, the manufacturing steps becomes complicated. Furthermore, the strength of a glass tube is lowered.

A fourth drawback is that high temperature heat treatment is required to bend a glass tube in the case where a ring-form fluorescent lamp is formed, so that the vitrification of the undercoat layer takes place in the heat treatment step, depriving a basic function as the undercoat layer. In addition, if alumina is used in the undercoat layer, the undercoat layer is liable to peel off when a glass tube is bent.

To overcome these drawbacks, Jpn. Pat. Appln. KOKAI Publication No. 2-216751 proposes an ultraviolet-suppressed fluorescent lamp having a coating layer made of a mixture of titanium oxide and zinc oxide fine powders formed on the outer surface of a glass tube. However, in this fluorescent lamp, when a content of zinc oxide is increased, a total luminous flux will increase but ultraviolet absorptivity will decrease. Conversely, when the content of titanium oxide is increased, the ultraviolet absorptivity will increase but a total luminous flux will decrease. In addition, since this fluorescent lamp absorbs a blue-region visible light, the color rendering properties thereof decrease, like the NU lamp described previously. As is described in the foregoing, a fluorescent lamp having a high ultraviolet absorptivity and total luminous flux of visible light equal to or more than that of an NU lamp, and excellent in color rendering properties has not yet been realized.

<Description of the fluorescent lamp of the present invention>

The present inventors have intensively studied for solving the aforementioned problems. As a result, they found that a fluorescent lamp with an undercoat layer having a high ultraviolet preventing effect, with a high luminous flux and excellent in color rendering properties, can be attained by using the phosphor film structure of the present invention.

To be more specific, the fluorescent lamp of the present invention is characterized in that an undercoat layer thereof employs the ultrafine phosphor particles mentioned above instead of a conventionally-used particulate material such as silicon dioxide, titanium dioxide, aluminum oxide, or cerium oxide.

Figure 3:
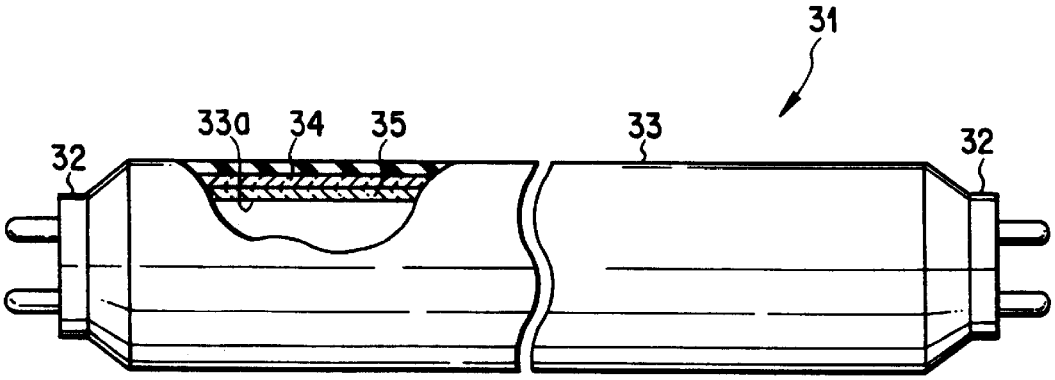
FIG. 3 is a partially cutaway view of an embodiment of the phosphor lamp of the present invention.

FIG. 3 is a cross sectional view showing a straight tube fluorescent lamp 31 according to an embodiment of the present invention. As shown in the figure, the fluorescent lamp 31 has a glass tube 33 having electrodes 32, 32 on both ends. The electrodes 32, 32 project inwardly in the glass tube. On the inner surface 33*a* of the glass tube 33, provided is an undercoat layer 34 comprising the ultrafine phosphor particles mentioned previously. On the undercoat layer 34, provided is a luminous layer 35 comprising phosphor particles having an average diameter of at least 1 $\mu$m. In the glass tube 33, an ionizable medium containing mercury is sealed.

In the fluorescent lamp of the aforementioned embodiment, the ultrafine phosphor particles constituting the undercoat layer 34 have both ultraviolet reflecting properties and visible light transmission ability. More specifically, the visible light generated in a luminous layer 35 is transmitted through the undercoat layer 34 but the ultraviolet rays generated in the luminous layer 35 is reflected by the undercoat layer 34. In this way, the undercoat layer 34 can act as an effective ultraviolet protection film. The reflected ultraviolet rays are absorbed by the phosphors contained in the luminous layer 35. As a result, the luminous layer 35 is not only excited by the ultraviolet rays radiated directly from a discharge space but also excited by the ultraviolet rays reflected from the undercoat layer 34.

In this mechanism, light can be efficiently emitted from the luminous layer 35.

In addition, the ultrafine phosphor particles of the undercoat layer 34 not only reflect or scatter ultraviolet rays but also emit light by absorbing part of ultraviolet rays. Therefore, if the weight of phosphor particles constituting the luminous layer 35 is the same as that used in the conventional fluorescent lamp, the fluorescence lamp employing the undercoat layer of the present invention can improve the luminescent brightness of a fluorescent lamp, compared to the fluorescent lamp using a conventional undercoat layer. On the other hand, to obtain the same brightness as that of the conventional fluorescent lamp, the weight of phosphors constituting the luminous layer 35 can be reduced, decreasing the manufacturing cost.

As is clear from the foregoing, the most important features of the fluorescent lamp of the present invention are visible light transmission properties and ultraviolet reflection properties of the undercoat layer 34. Concerning the ultraviolet reflection properties, it is desired that ultraviolet rays, particularly, the ray having a wavelength of 254 nm, be reflected by the fluorescent lamp, efficiently. The phosphor particles reflecting (or scattering) a light having a wavelength of $\lambda$ most efficiently should be determined by the following equation.

$$d = \frac{\lambda}{1.414 \cdot n_0 \cdot \pi} \cdot \frac{m^2 + 2}{m^2 - 2}$$

where, $\lambda$ is a light wavelength; m is $n_p/n_0$; and $n_p$ and $n_0$ are refractive indexes of particles and a dispersion medium, respectively.

In accordance with this equation, in order to reflect an ultraviolet ray of 254 nm wavelength efficiently and to transmit visible light of 400–750 nm wavelength sufficiently, it is preferable to set an average diameter of the ultrafine phosphor particles to 150 nm or less, more preferably to 10–50 nm.

The ultrafine phosphor particles to be used in the undercoat layer 34 can be manufactured by the method previously explained. The ultrafine phosphor particles thus obtained are high in crystallinity, unlike the ultrafine particles manufactured by another method such as a wet method. Therefore, even if they are exposed to a high temperature, for example, in the fluorescent lamp manufacturing step, gasification and decomposition will not occur. As a result, the function as the undercoat layer will not be damaged. Accordingly, the fluorescent lamp of the present invention can be advantageously applied to a ring type fluorescent lamp requiring a heat treatment process at a high temperature. When a raw phosphor material is treated by a thermal plasma, the phosphor material is vaporized or molten. The vaporized phosphor is turned to fine phosphor particles; on the other hand, the molten phosphor is turned to spherical phosphor particles. The spherical phosphor particles can be used as phosphor particles constituting the luminous layer 35.

The amount of the ultrafine phosphor particles contained in the undercoat layer 34 is preferably 5–500 $\mu g/cm^2$, more preferably 5–50 $\mu g/cm^2$. If the amount of the ultrafine phosphor particles is less than 5 $\mu g/cm^2$, the ultraviolet reflecting effect mentioned above may not be sufficiently obtained. On the other hand, in excess of 500 $\mu g/cm^2$, the transmission of visible light will be provably decreased.

The phosphor material to be used in the ultrafine phosphor particles is preferably the same as those used in a general fluorescent lamp. The examples include oxysalt compound and double oxide, such as phosphate phosphor, halophosphate phosphor, silicate phosphor, tungstate phosphor, aluminate phosphor, germanate phosphor, and arsenate phosphor; rare earth oxide phosphor; and the like. These phosphor materials for a lamp absorb an ultraviolet ray of 254 nm efficiently but do not absorb light of a blue light zone around 400 nm. Therefore, a color shift problem, which is seen in the case of a conventional undercoat layer made of titanium dioxide particles, will be avoided in this case. In the case where the luminous layer 35 is formed of a mixture containing a plurality of phosphors, it is preferred that at least one type of phosphors contained in the phosphor mixture have a common composition with that of the ultrafine phosphor particles.

To form the undercoat layer 34 on the inner surface of a glass tube 33, the ultrafine phosphor particles are dispersed in a solvent such as water or alcohol and then formed into the undercoat layer in accordance with a phosphor film formation method employed in forming a general fluorescent lamp. In forming the undercoat layer 34, a binder may be used. As the binder, use may be made of various binders including nitrocellulose dissolved in butyl acetate, and a water soluble binder such as ammonium polymethacrylate. A more preferable binder is one hardly degraded by ultraviolet rays, capable of transmitting visible light, having a good adhesiveness to a glass tube, film strength, good film formation properties, and good drying characteristics. Examples of such a binder include butyral resin; acrylic resin; fluorine resin; silicone resin; alkali silicate such as sodium silicate; inorganic colloid such as silica sol, alumina sol; alkylsilicate such as tetraethoxysilane; phosphates such as aluminum phosphate; organo-metallic compounds such as metal alkoxide, aluminum chelate, and tin acetate. The content of the binder is 0.1 to 500 parts by weight, preferably 0.1 to 100 parts by weight relative to 100 parts by weight of ultrafine phosphor particles. When the amount of the phosphor particles is excessively small, a sufficient ultraviolet protecting function cannot be obtained. Therefore, the film thickness must be increased. Conversely, if the amount of phosphor particles is excessively large, the adhesivity of the undercoat layer 34 to a glass tube will be weak, decreasing film strength and transmissivity of visible light.

The luminous layer 35 formed on the undercoat layer 34 can be formed of various phosphor particles as is the same as in the cases of general fluorescent lamps and thus are not particularly restricted in phosphor type. Examples of the phosphor particles include monochromatic phosphor particles; a mixture of three types of phosphor particles respectively emitting blue, green, and red; a mixture of phosphor particles, further comprising phosphor particles emitting blue-green or phosphor particles emitting deep red to the aforementioned mixture for the purpose of increasing color rendering properties; and a mixture of phosphor particles having at least two phosphor particles emitting different colors which are chosen depending on a desired emission color of a lamp.

The shape of phosphor particles constituting the luminous layer 35 will not be particularly restricted but it is desirable that spherical phosphor particles having an average diameter of, particularly, 1 to 20 $\mu$m, preferably 1 to 10 $\mu$, may be used. If such spherical phosphor particles are used, the visible light transmission properties of the luminous layer 35 itself will be improved, increasing the brightness of the fluorescent lamp 31. As the spherical phosphor particles, use may be made of the spherical particles, which are secondarily produced when the ultrafine phosphor particles are manufactured, as explained above.

Incidentally, the fluorescent lamp of the present invention can be applied to fluorescent lamps of various shapes such as a ring-shaped fluorescent lamp, U-shaped fluorescent lamp, other than a straight tube type.

Ultraviolet rays-suppressed light source

<Background>

A second applied embodiment is an ultraviolet-suppressed light source. The same problems as those mentioned with respect to the fluorescent lamp are also present in the case of a halogen lamp and an HID lamp (High Intensity Discharge Lamp). That is, in the case of these lamps, the suppression of ultraviolet radiation and the improvement of color rendering properties are also required. For this reason, it is desired to develop a lamp structure for suppressing ultraviolet rays, and applicable to other types of lamps such as a halogen lamp and an HID lamp other than the fluorescent lamp.

<Description of the ultraviolet-suppressed light source of the present invention>

The ultraviolet-suppressed light source of the present invention uses a film, which is made of the same ultrafine phosphor particles as those used in the undercoat layer of the fluorescent lamp already described above, not as an undercoat layer of the luminous layer provided within a glass tube but as a outer coating layer covering the outer surface of the glass tube to suppress ultraviolet rays. By this structure, a light flux is increased and color rendering properties are improved.

Figure 4:
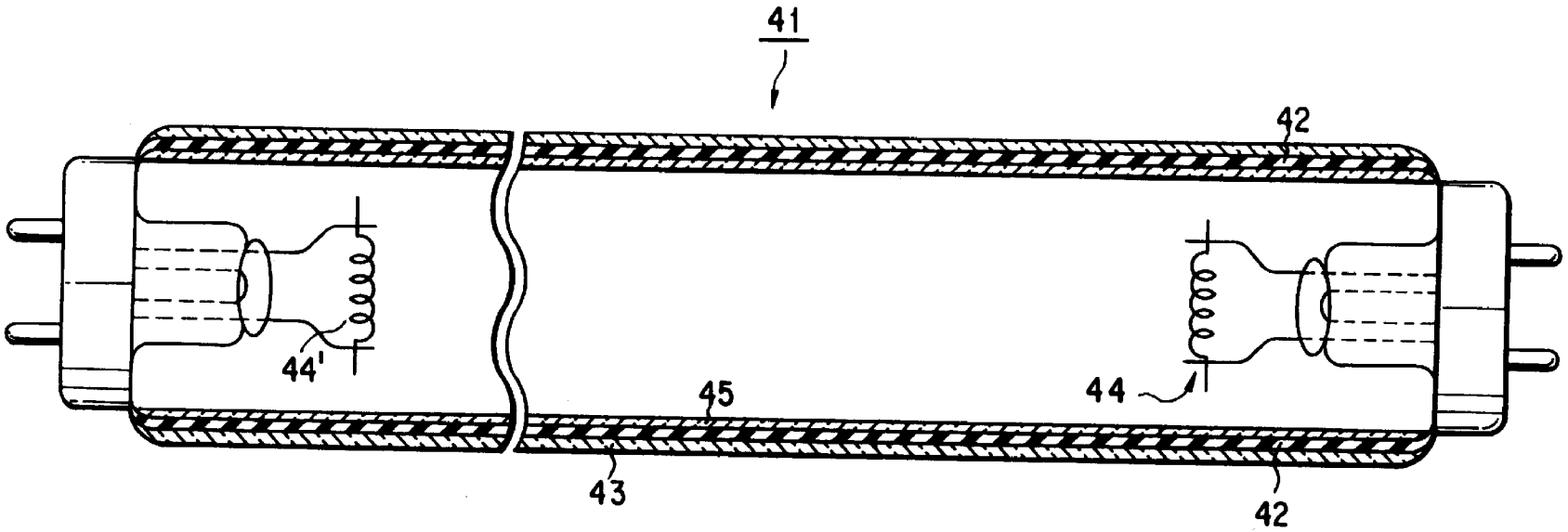
FIG. 4 is a cross sectional view showing an embodiment of the ultraviolet-suppressed light source of the present invention.

FIG. 4 is a cross sectional view of an ultraviolet-suppressed light source 41 employing the present invention as a fluorescent lamp. As shown in the figure, to the inner sides of both ends of a glass tube 43, a pair of electrodes 44 and 44' are provided. To the inner surface of the glass tube 43, provided is a luminous layer 45 made of phosphor particles. In the interior space of the glass tube 43, a rare gas such as an argon gas is sealed. This structure is similar to that of a general fluorescent lamp. In the ultraviolet-suppressed light source shown in FIG. 4, on the outer surface of the glass tube 43, an ultraviolet absorbing layer 42 is formed which contains the ultrafine phosphor particles. This is the only one point distinguishing it from a general fluorescent lamp.

The ultrafine phosphor particles contained in the ultraviolet absorbing layer 42 are particles having an average diameter of at most 200 nm, which are obtained by heating a phosphor material to vaporize and then quenching rapidly to solidify. Since the phosphor particles are the same as those already explained, we will omit the details thereof. In this case, however, as the ultrafine phosphor particles, use is made of the phosphor material capable of absorbing ultraviolet rays having a long wavelength near 365 nm. Examples of such a phosphor include oxysalt compounds and double oxide compounds, such as a phosphate phosphor, halophosphate phosphor, silicate phosphor, tungstate phosphor, aluminate phosphor, germanate phosphor, and arsenate phosphor, as shown in the following chemical formulas:

$(Sr, Mg)_3(PO_4)_2:Sn^{2+}$, $Sr_2P_2O_7:Eu^{2+}$, $(Sr, Mg)_2P_2O_7:Eu^{2+}$, $Sr_3(PO_4)_2:Eu^{2+}$ $2SrO.0.84P_2O_5.0.16B_2O_3:Eu^{2+}$ $Ba_2MgSi_2O_8:Eu^{2+}$ $(Sr, Ba)Al_2Si_2O_8:Eu^{2+}$ $Y_2SiO_3:Cc^{3+}, Tb^{3+}$, $Ba_{0.8}Mg_{1.93}Al_{16}O_{27}:Eu, Mn$ $SrB_4O_7F:Eu^{2+}$, $6MgO.As_2O_5:Mn^{4+}$, $3.5MgO.0.5MgF.GeO_2:Mn^{4+}$, $6MgO.As_2O_5:Mn^{4+}$

The phosphors absorbing long wavelength ultraviolet rays, which are listed above, not only absorb ultraviolet rays but also emit specific fluorescence having wavelengths inherent in the phosphor materials. Therefore, the color rendering properties of a light source can be improved in comparison with a conventional lamp using titanium oxide, zinc oxide, or the like for preventing ultraviolet rays. For example, $3.5MgO.0.5MgF.GeO_2:Mn^{4+}$ phosphor and $6MgO.As_2O_5:Mn^{4+}$ phosphor absorb an ultraviolet ray having a long wavelength near 365 nm and emit deep red light having a peek at about 660 nm. Hence, a special color rendering index ($R_9$) regarding a red color of high chroma can be improved. A $(Sr, Mg)_3(PO_4)_2:Sn^{2+}$ phosphor, $Sr_2P_2O_7:Eu^{2+}$ phosphor, $(Sr, Mg)_2P_2O_7:Eu^{2+}$ phosphor, and the like emit blue light of 400–450 nm. A $2SrO.0.84P_2O_5.0.16B_2O_3:Eu^{2+}$ phosphor emits blue-green light of about 480 nm.

The method of manufacturing the ultraviolet-suppressed light source of the present invention is similar to the method of manufacturing a general lamp except that the ultraviolet suppressing layer 42 is formed. In other words, in order to form the ultraviolet-suppressed light source, the ultraviolet suppressing layer 42 may be simply provided onto the outer surface of a fluorescent lamp, a halogen lamp, and an HID lamp.

The method of forming the ultraviolet suppressing layer 42 is similar to that of forming an undercoat layer in a fluorescent lamp mentioned above. The type and amount of a binder to be used are also the same. However, in the case of a lamp generating a high temperature such as an HID lamp (300° C.), it is preferred to use a binder other than a butyral resin, acrylic resin, and fluorine resin, in view of heat resistance. As a solvent, the solvents already mentioned may be used. However, in the case of the HID lamp and the like, preferred is a solvent capable of being vaporized and dried away at a temperature near 300° C., which is actually generated during a lighting test. In addition, together with a binder, a surface treatment agent, dispersant, lubricant, drying agent, anti-foaming agent, curing agent, and the like may be added in an extremely small amount, if necessary.

The ultraviolet suppressing layer 42 is formed so as to have a thickness generally in the range of 0.1–100 $\mu$m, preferably 0.5–30 $\mu$m, more preferably 1–15 $\mu$m. If the thickness is thinner than 0.1 $\mu$m, ultraviolet rays will not sufficiently absorbed and pin holes are likely formed. Conversely, if the film is thicker than 100 $\mu$m, the transmission properties of visible light decrease, degrading adhesiveness to the glass tube 43.

After the ultraviolet suppressing layer 42 is formed, an overcoat layer may be formed, if necessary, in order to increase gloss, strength, surface hardness, and the like of the phosphor film.

In the ultraviolet suppressing layer 42, heat deterioration with time is scarcely observed since the ultrafine phosphor particles constituting the layer 42 have high crystallinity and stable. Therefore, an ultraviolet absorbing function can be obtained always stable. Furthermore, the phosphor particles constituting the ultraviolet suppressing layer 42 contribute to improving color rendering properties of a luminescent source since they emit light of a desired wavelength by themselves. In addition, since the ultrafine phosphor particles having an average diameter of 200 nm or less, are used, the ultraviolet suppressing layer 42 can be formed extremely thin. Even the layer is thin, the ultraviolet absorbing ability can be sufficiently exhibited. Since the ultrafine phosphor particles are transparent as mentioned above, the light flux of a luminescent source will not be declined. The ultraviolet-suppressed luminescent light source can be formed simply by providing the ultraviolet suppressing layer on the outer surface of a glass tube constituting a ready-made luminescence source. Hence, a cost is lower compared to the case in which an ultraviolet suppressing layer is provided on the inner surface of the glass tube.

Luminous panel and transparent luminous material

<Background>

A third application embodiment is a luminous panel and the fourth application embodiment is a transparent luminous material. The luminous panel, which has been conventionally well known, is a panel on which letters and figures are drawn with a luminous paint. The luminous panel is luminous in the nighttime and in the dark since the luminous paint thereof is excited by sunbeam or fluorescent light and emit light. Therefore, the panel is used as safety-sign boards for the nighttime, as clockfaces, and the like. However, in any cases, the use of the luminous panel is limited to the cases in which figures (letters and patterns) to be seen in the light are identical to those to be seen in the dark. For example, a conventional luminous panel is formed by coating the luminous paint onto an appropriate substrate. The luminous paint used herein made of a mixture of luminous phosphor particles of several $\mu$m diameters and a transparent binder. Since the luminous phosphor particles of this size scatter or reflect visible light (400–750 nm in wavelength), the figures drawn with the luminous paint can be seen in the light. On the other hand, in the dark, with the aid of luminescence provided from the luminous phosphor particles contained the luminous paint and with the help of the reflection of visible light slightly present even in the dark, the figures drawn with the luminous paint can be observed by the naked eye.

As mentioned above, since the luminous paint using the conventional luminous material acts similarly to a general paint in the light, the figures seen to be in the light must be drawn identically to those to be seen in the dark. To explain more precisely, in the case where the figure for the dark is drawn with the luminous paint overlapped upon the figure for the light, if both figures differ in pattern, the figure for the dark will be seen in an overlapped manner with the figure for the light, in the light. In essence, it has been basically impossible to draw figures seen in the dark which is different from that seen in the light, in the case of the luminous panel using the conventional luminous paint.

For the similar reason, it has been impossible to draw figures with the luminous paint on a base material, such as window glass, which is principally required to be transparent in the daytime. Similarly, in the case of such a base material as window glass required to be transparent in the light, it has been also impossible to prepare a luminous panel with the intention of night use by dispersing luminous particles directly in a base material.

On the other hand, another attempt has been carried out in which decoration including letters and figures is made on a wall by using a transparent fluorescent paint instead of the luminous paint and the decoration is rendered luminous by black light lamp (emitting only ultraviolet rays) in the nighttime. However, compared to the use of a luminous paint, this method has problems in that electric power is required and in that adverse effects of ultraviolet rays on a human body must be considered.

Under the aforementioned circumstances, to promote the utilization of luminous panel in various fields, it has been desired to develop a luminous panel which is seen only in the dark but is transparent in the light. This can be achieved by using a luminous paint having characteristics of being transparent in the light and emitting light in the dark for a long time. In addition, the transparent luminous base material is desired to be transparent in the light like glass and emitting light in the dark.

<Description of the luminous panel and the transparent luminous material of the present invention>

The luminous panel of the present invention is formed of a substrate and a luminous painting layer on the substrate wherein the luminous painting layer comprises ultrafine phosphor particles having an average diameter of 200 nm or less obtained by heating a long persistent inorganic phosphor material to vaporize and then rapidly quenching to solidify.

The transparent luminous material of the present invention is formed by dispersing ultrafine phosphor particles having an average diameter of 200 nm or less into a transparent substrate, wherein the ultrafine phosphor particles are obtained by heating a long persistent inorganic phosphor material to vaporize and then rapidly quenching to solidify.

As described before, particles having an average diameter shorter than the wavelength of visible light (400–750 nm) allow visible light to transmit even through the film made of the particles has a thickness of several tens of $\mu$m. Hence, if the figures to be seen in the dark is drawn on the substrate, on which figures to be seen in the light has been already drawn, by use of the luminous layer containing the ultrafine particles of a long persistent inorganic phosphor, in an overlapped manner, the underlying figures for the light will be visible only in the light, whereas the figures for the dark will be visible only in the dark. Furthermore, if the ultrafine particles of a long persistent inorganic phosphor are dispersed in a base material such as transparent glass or a transparent binder, the transparent luminous material thus obtained appears transparent in the light but luminous in the dark.

The ultrafine phosphor particles to be used in the luminous panel and the transparent luminous material of the present invention are basically the same as explained above. Therefore, we will omit the details and explain only specific matters as to the luminous panel and the transparent luminous base material.

As the characteristics for the ultrafine phosphor particles to be used in the luminous panel and the transparent luminous material, long light persistency is inevitably required by its nature. Examples of the long persistent inorganic phosphor include Zinc sulfate series phosphor:

ZnS:Cu, ZnS:Cu, Co, etc.

Calcium sulfate series phosphor:

CaS:Eu, Tm, (Ca, Sr)S:Bi (Ca, Sr)S:Ce, Bi, etc.

Strontium sulfate series phosphor:

SrS:Eu, Sm, SrS:Ce, Sm etc.

Furthermore, a recently-found long persistent inorganic phosphors shown below which has high brightness may be used.

$SrAl_2O_4$:Eu, $SrAl_2O_4$:Eu, Dy $CaAl_2O_4$:Eu, Nd

Among the aforementioned long persistent inorganic phosphors, $SrAl_2O_4$:Eu system, for example, has an emission peak at 510 nm under ultraviolet excitation, thus emitting green light. This phosphor, if used in a single form, of course, emits green light. However, if used in a combination form with various organic fluorescent pigments or the like, for example, by dispersing the phosphor in a binder together with the organic fluorescent pigments, this phosphor will provide various emission colors. In this way, letters and figures can be drawn by various colors. In the case where the fluorescent pigments are mixed, they are not necessary to have long light persistency. The fluorescent pigments emit light not by ultraviolet radiation, but by absorbing short-wavelength visible light emitted by the ultrafine particles of a long persistent inorganic phosphor dispersed together with the pigments. Therefore, even in the dark, light can be emitted from the fluorescent pigments together with the light supplied from the long persistent inorganic phosphor particles. Instead of organic fluorescent pigments, use may be made of ultrafine particles of an inorganic phosphor such as $6MgO.As_2O_5$:Mn, which is excited by short-wavelength visible light and emits light.

Figure 5:
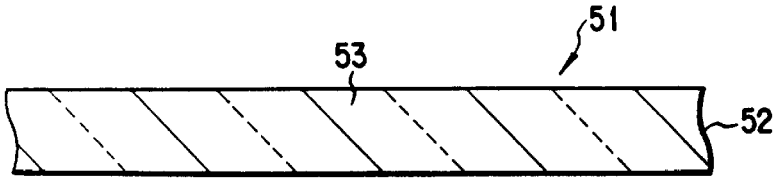
FIG. 5 is a cross sectional view showing an embodiment of the transparent luminous material of the present invention.

FIG. 5 is a cross sectional view showing a transparent luminous material 51 according to an embodiment of the present invention. In the figure, reference numeral 52 is a transparent base such as a glass plate, resin plate, and film. The transparent base 52 is not necessary to be completely transparent and may have transparency at the degree required by specific use. In the transparent base 52, the ultrafine particles 53 of the long persistent inorganic phosphor are dispersed. As the transparent base 52, any material including a hard base and a soft base may be used, as is mentioned above. Furthermore, the base 52 is not necessary to be solid, so that paste form and ink form may be acceptable. Furthermore, not only colored transparent base material but also colorless transparent base material may be used.

The transparent luminous material 51 can be manufactured by adding and mixing the ultrafine particles of a long persistent inorganic phosphor to the raw material for the transparent base 52. If necessary, by molding the mixture by an appropriate method, the transparent luminous material 51 may be manufactured. Since the long persistent inorganic phosphor is provided in the form of ultrafine particles, the phosphor can be easily and uniformly mixed in, e.g., a glass material or a resin material. As previously described, since the ultrafine particles of a long persistent inorganic phosphor can be obtained by use of a high frequency thermal plasma and the like, they have quite high crystallizabilities and stability. Hence, they cannot be easily decomposed even if exposed to a high temperature at a step of manufacturing luminous glass and the like. As a result, the transparent luminous material 51 can be obtained with a good reproducibility.

The transparent luminous material 51 mentioned above can be applied to a wide variety of usages which specifically shown below:

(1) If a glass window, a glass door, front glass cover of a shelf, and a glass tumbler are formed of the transparent luminous material 51, they appear to be transparent in the daytime and under illumination, whereas in the nighttime, they are visible enough to know its location easily. Even at the time of earthquake in which glass wears are broken into pieces and no light is supplied, it can be easy to know where the broken pieces are. Therefore, the transparent luminous material 51 is useful from the view point of safety. When a glass tumbler is broken, if a room is darkened to allow the pieces luminous, the locations of the pieces can be easily confirmed. Then, the broken pieces can be easily picked up and cleared (2) The transparent luminous material 51 can be applied to contact lenses. Although the contact lenses must be transparent in consideration of functions, in general, they are slightly colored in order to easily find when dropped off. If the ultrafine particles of a long persistent inorganic phosphor of the present invention are dispersed in the contact lenses, the dropped contact lenses can be easily found without reducing the transparency of the lenses. The lenses, if dropped, can be found easily by darkening the surroundings to allow the lenses luminous.

(3) If the ultrafine particles of a long persistent inorganic phosphor are dispersed in a soft transparent base such as film or tape, the resultant soft transparent luminous material can be used as guiding signs in the dark. To be more specific, by adhering the soft transparent luminous material on and along an evacuation way, the evacuation way can be visible even in the dark. Alternatively, if the soft transparent material is adhered on projections of a wall and ceiling, it will act as a warning sign to give a notice of danger.

Furthermore, if the ultrafine particles of a long persistent inorganic phosphor are dispersed in a curtain made of a transparent film and used as a partition wall of a room, the room will appear to be divided visually into completely two spaces under the slightly dark illumination.

(4) If the ultrafine particles of a long persistent inorganic phosphor are dispersed in a transparent base such as a transparent binder of liquid form or paste form, the resultant luminous transparent material can be used as a transparent luminous paint or transparent luminous ink. The transparent luminous paint and ink, for example, can be used in the following usages:

If the transparent luminous paint is used, letters and figures are visible only at night. Since the figures are non-visible in the daytime, the figures will not damage the appearance of the wall in the daytime. If the transparent luminous ink is used, secret documents and the like can be made by writing letters by a normal pen, and then adding a secret writing with the transparent luminous ink thereto. Alternatively, the transparent luminous paint and ink can be applied to something to wear such as clothes and shoes. If letters and patterns are drawn or print with the transparent luminous paint or ink on children's clothes, attention can be drawn to a child in the nighttime so as not to lose sight of the child.

Figure 6:
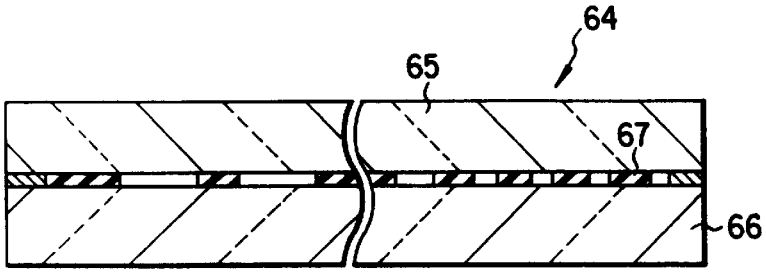
FIG. 6 is a cross sectional view showing an embodiment of the luminous panel of the present invention.

FIG. 6 is a cross sectional view of a luminous panel 64 according to an embodiment of the present invention. As shown in the figure, a luminous layer 67 made of the ultrafine particles of a long persistent inorganic phosphor is interposed between an upper transparent substrate 65 and a lower transparent substrate 66 and its outer peripheral portion is sealed. The luminous layer 67 may be formed on the entire surface of the substrates 65 and 66 or in a desired pattern. As the transparent substrates 65 and 66, use may be made of a glass plate, resin plate, film, and the like. Such a luminous panel 4 is formed by forming the luminous layer 67 made of the ultrafine particles of a long persistent inorganic phosphor on either the substrate 65 or the substrate 66, adhering the other substrate thereon, and sealing the outer peripheral portion. Alternatively, the luminous layer 67 is formed by coating the transparent luminous paint mentioned above on a transparent substrate.

Since the luminous panel 64 comprises transparent substrates 65 and 66 and the luminous layer 67 transparent in the light, it will not lose the transparency inherently required for a glass window and a display window in the light. Whereas, in the nighttime, if desired figures are drawn in the luminous layer 67, the figures can be seen since the luminous layer 67 is luminous in the dark. Therefore, if the luminous panel 64 is applied to display windows at department stores, the windows serve as display windows without losing transparency in the daytime, whereas, in the nighttime, advertisement and decoration will be emerged on the display windows.

Figure 7:
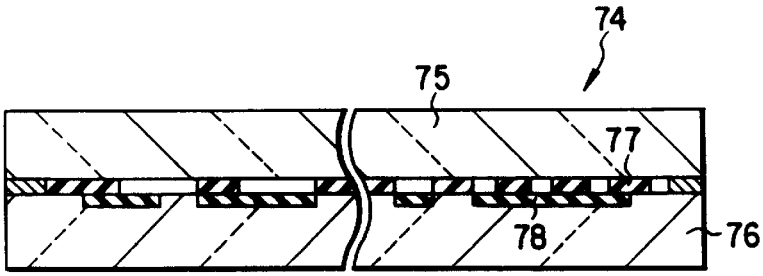
FIG. 7 is a cross sectional view showing another embodiment of the luminous panel of the present invention.

Furthermore, as shown in FIG. 7, if underlying figures 78 such as letters and patterns are previously drawn onto a surface of lower substrate 76, only the underlying figures 78 will be visible in the light, whereas, only the figure drawn in the luminous layer 77 will be visible in the dark. In this manner, different figures can be presented depending on light or dark circumstances.

Figure 8:
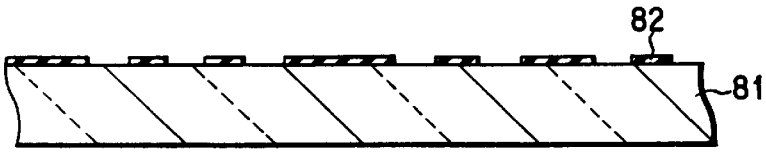
FIG. 8 is a cross sectional view showing a further embodiment of the luminous panel of the present invention.
Figure 9:
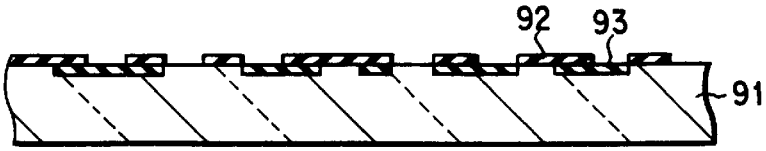
FIG. 9 is a cross sectional view showing still further embodiment of the luminous panel of the present invention.

The luminous panel of the present invention may be manufactured by use of the transparent luminous paint mentioned above. FIG. 8 shows a luminous panel on which desired figures are drawn by coating a transparent luminous paint 82 on a transparent substrate 81. As show in FIG. 9, it is possible to draw underlying figures 93 on a transparent substrate 91 in advance besides the figures drawn with a transparent luminous paint 92. The luminous panel thus obtained can be used in the same usages as those of the luminous panel shown in FIGS. 6 and 7. In addition, quite fine patterns can be advantageously drawn by virtue of the transparent luminous paints 82 and 92.

In the luminous panel of the present invention using the transparent luminous paint, not only a transparent substrate but also a non-transparent substrate may be used. Examples of such a non-transparent substrate 12 include various types of plates made of a metal, synthetic resin and wood. The luminous panel is useful as a safety-sign board. In particular, if the same embodiment as shown in FIG. 5 is employed, it is possible to provide a safety-sign board indicating different warning messages between the daytime and the nighttime.

Hereinbelow, the present invention will be described in details by way of Examples.

First of all, Examples and Comparative Examples of the phosphor film structure of the present invention.

EXAMPLE 1

$Y_2O_3$:Eu phosphor particles (concentration of Eu:0.1%) having an average diameter of 3 $\mu$m, which was previously prepared by the oxalate coprecipitation method, were vaporized by the high frequency thermal plasma process and then rapidly quenched to obtain fine phosphor particles. The fine phosphor particles thus obtained had a primary particle diameter of 50 nm–2 $\mu$m.

Figure 10:
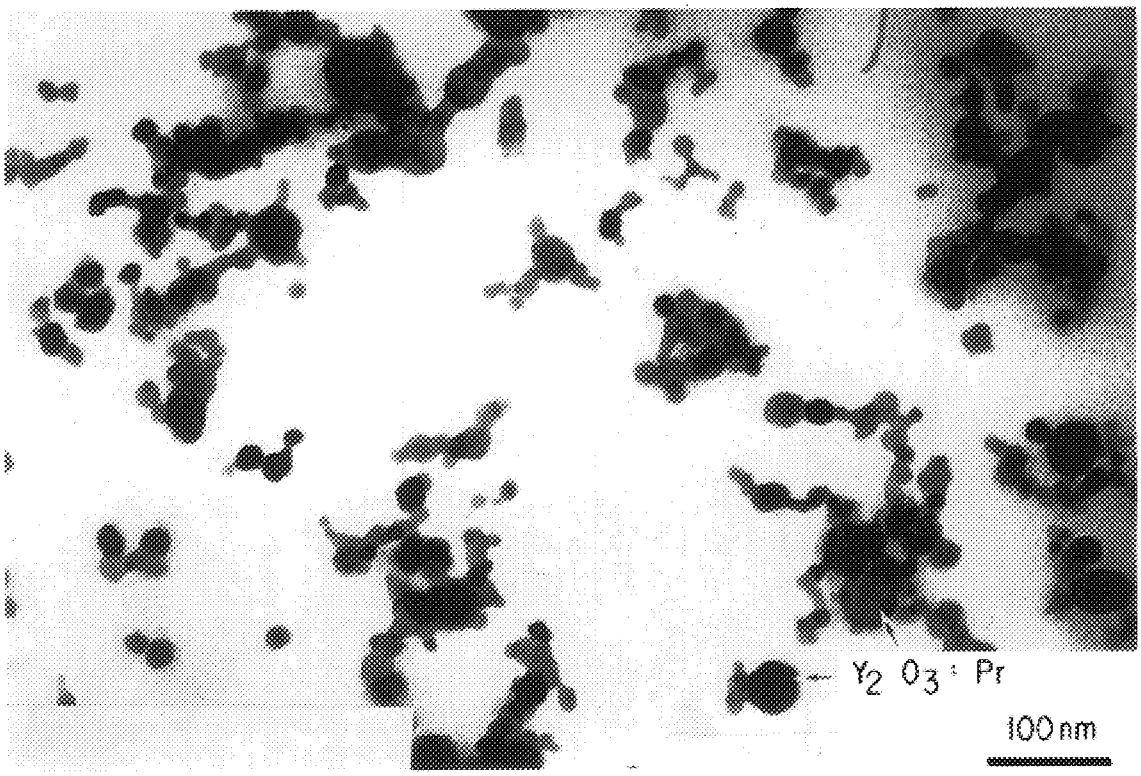
FIG. 10 is a transmission electron photomicrograph of the ultrafine phosphor particle used in the present invention.

Subsequently, the fine phosphor particles were dispersed in ethanol containing polyvinyl pyrrolidone (PVP) in an amount of 0.2% and centrifugally classified. To describe more specifically, after centrifugation was performed at 5000 rpm for 30 minutes, the supernatant was taken. As was observed by transmission electron microscope (TEM), the supernatant contained the fine phosphor particles having an average diameter of about 40 nm. The ratio of particles having diameters of at least 300 nm was 1% or less. The TEM photograph of the supernatant is shown in FIG. 10.

Figure 11:
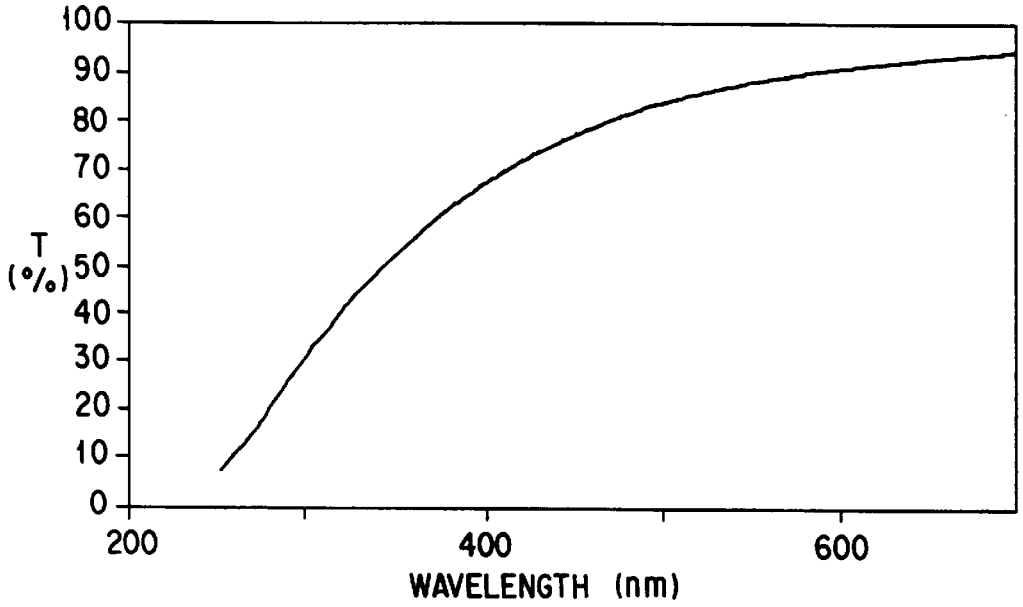
FIG. 11 is a graph showing an example of a transmission spectrum of the phosphor film in the phosphor film structure of the present invention.
Figure 12:
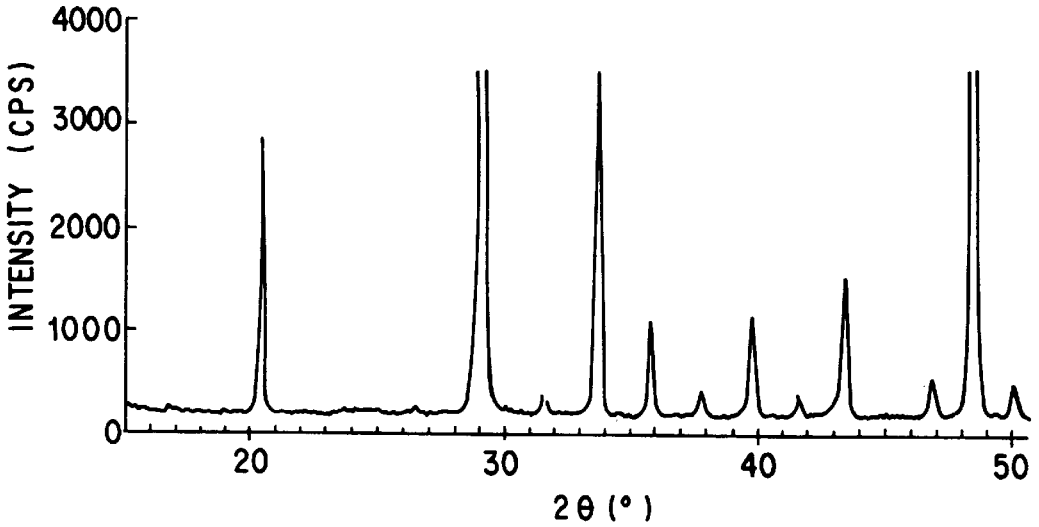
FIG. 12 is a graph showing an example of an X-ray diffraction pattern in the phosphor film structure of the present invention.

Thereafter, the supernatant was coated on a glass substrate by dip coating to form a 2 m-thick phosphor film. In the resultant phosphor film, a regular light transmission rate and a haze relative to light having a wavelength of 400–700 nm was 86% and 20%, respectively, demonstrating that the phosphor film had quite good transparency. The transmission spectrum and the X-ray diffraction pattern of the phosphor film are shown in FIG. 11 and FIG. 12, respectively.

EXAMPLES 2 TO 5

As raw material phosphors, used were $Y_2O_3$:Pr (concentration of Pr:0.1%, Example 2), $CaWO_4$ (Example 3), ZnS:Ag, Al (concentrations of Ag and Al: 0.05%, Example 4), and SrS:Ce (concentration of Ce:0.1%, Example 5). The raw material phosphors were vaporized by the high frequency thermal plasma process and then rapidly quenched to obtain ultrafine phosphor particles.

Subsequently, the ultrafine phosphor particles were separately dispersed in ethanol containing 2% of PVP and centrifugally classified in the same manner as in Example 1. The resultant supernatants contained primary particles having an average diameter of 80–150 nm. The ratio of particles having diameters at least 300 nm was 5% or less in each case.

Using the supernatants, the dip coating was performed. As a result, 2 $\mu$m-thick phosphor films were formed separately on glass substrates. The regular transmission light amounts of the obtained phosphor films to a light flux of 380–760 nm wavelength fall within the range of 50–80%, hazes were in the range of 20–50%. The resultant phosphor films were thus good in transparency.

EXAMPLES 6–9

As raw material phosphors, used were $Gd_2O_2S$:Pr (Example 6), $La_2O_2S$:Eu(Example 7), $Gd_2O_3$:Pr (Example 8), and $La_2O_3$:Tb(Example 9)(each of Pr, Eu and Tb were used in an amount of 0.1%). The raw material phosphors were vaporized by the high frequency thermal plasma process and then rapidly quenched to obtain fine phosphor particles. The resultant fine phosphor particles had a primary diameter of 50 nm–2 m.

Subsequently, the fine phosphor particles were respectively dispersed in ethanol containing 2% of PVP and centrifugally classified in the same manner as in Example 1. The resultant supernatants contained primary particles having an average diameter of 30–100 nm. The ratio of particles having diameters of at least 300 nm was 5% or less in each case.

Using the supernatants, the spin coating was performed. As a result, 1 $\mu$m-thick phosphor films were formed on glass substrates. The regular transmission light amounts of the obtained phosphor films to a light flux of 380–760 nm wavelength fall within the range of 70–90%, hazes were in the range of 10–30%. The resultant phosphor films were thus quite good in transparency.

Comparative Example 1

Figure 13:
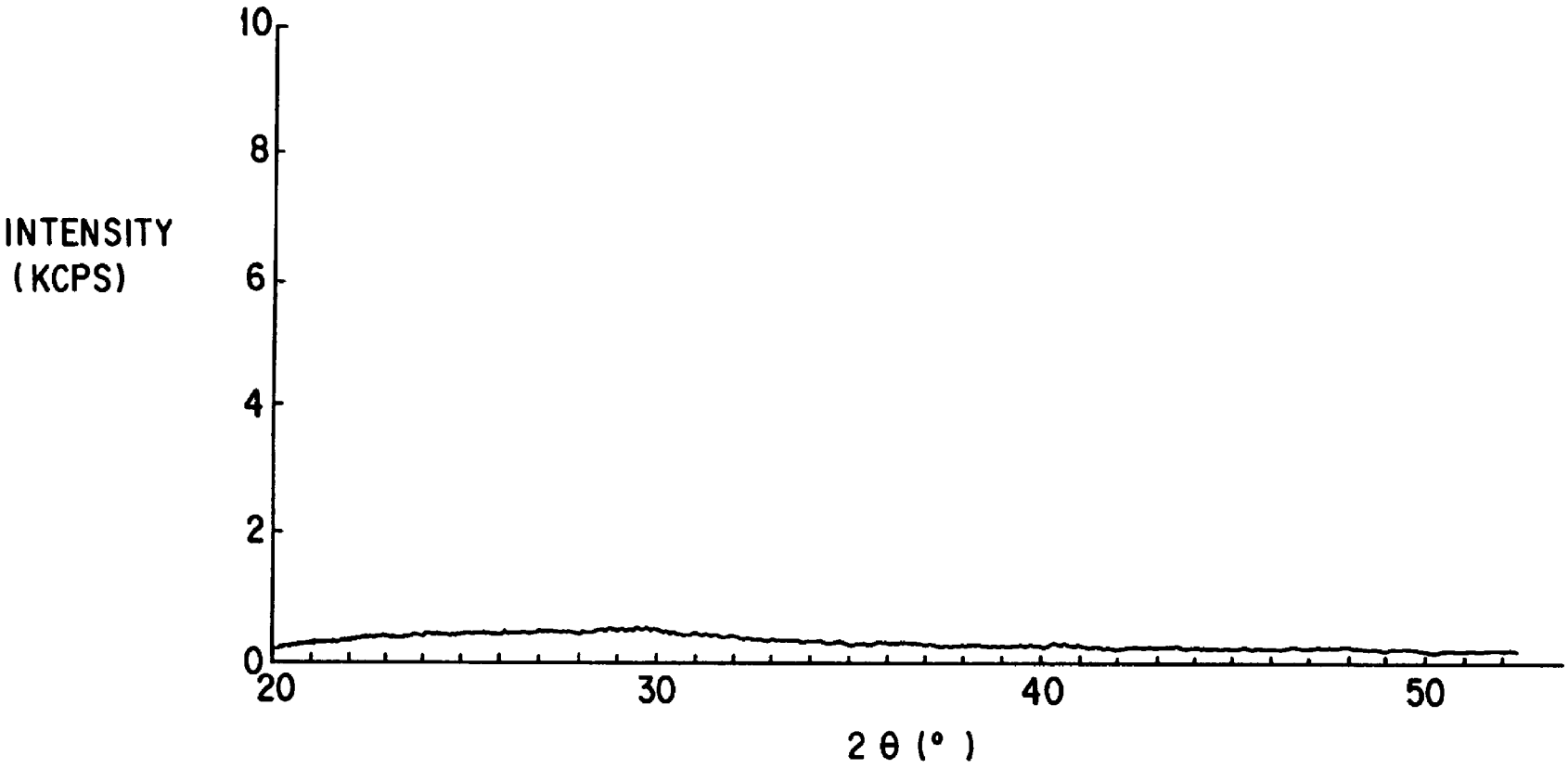
FIG. 13 is a graph showing an X-ray diffraction pattern of the phosphor film prepared as a comparative example.

A $Y_2O_3$:Eu thin film of 1.5 $\mu$m thick was formed on a glass substrate by the electron deposition method. Chemical analysis and X ray diffraction were performed with respect to the thin film. The X ray diffraction pattern of this thin film is shown in FIG. 13.

As a result of the chemical analysis, it was confirmed that the thin film contained $Y_2O_3$:Eu. However, the result of the X ray diffraction demonstrated that the thin film had a glass phase as shown in FIG. 6, demonstrating that the thin film obtained had an extremely poor crystallizability and many defects, compared to the phosphor film obtained in Example 1 shown in FIG. 5.

EXAMPLE 10

A commercially available $Y_2O_3$:Eu phosphor was valorized by supplying into the high frequency thermal plasma of 4 MHz and 29 kW in a mixed atmosphere of oxygen (25% by volume) and argon, and then rapidly quenched to obtain phosphor powder containing fine particles. The obtained phosphor powder was observed by a transmission electron microscope. As a result, it was found that the particles in the order of $\mu$m were contained in a large amount and the particles of at most 200 $\mu$m were contained in a volume of about 30%. The average diameter of the particles obtained was 1.8 $\mu$m as measured by an air transmission method.

Thereafter, an apparatus shown in FIG. 2 was prepared. A suspension solution 21 was prepared by dispersing the aforementioned fine phosphor particles in an amount of 0.1 wt % in isopropyl alcohol containing 0.1 wt % of lanthanum nitrate and 1 volume % of pure water, and then poured into a vessel 26. As a glass substrate 22, use was made of a glass plate of 2.5 cm×2.5 cm the surface of which was coated with an ITO film. The glass plate was positioned in such a way that the ITO film coated surface is opposed to an electrode 24 at a distance of 10 cm apart. While this state is maintained, a current of 5 mA was supplied for 5 minutes to the ITO coating film used as a cathode, thereby forming a phosphor film on the ITO coating film.

The phosphor film has a coating weight of 0.95 mg/cm$^2$. The fine phosphor particles of the phosphor film had an average diameters of 60 nm. The phosphor film appeared to be transparent and had a haze of 16%. The total light transmission rate of the phosphor film to white light was 76%.

Furthermore, on the phosphor surface, an alumi back was formed. Excitation was performed by supplying an electron beam having an acceleration voltage of 25 kV in the form of a linear pattern varying a distance between lines variously. As a result, a MTF curve was obtained. A space resolution showing a MTF value of 30% was 1601 p/mm, which was a quite high value.

Comparative Example 2

The same $Y_2O_3$:Eu phosphor particles as used in Example 10 were dispersed in an aqueous water glass solution. The dispersion solution was poured into a vessel containing a barium nitrate solution with a glass substrate placed on the bottom and allowed to stand still, thereby forming a phosphor film on the glass substrate.

The obtained phosphor film had a coating weight of 50 mg/cm$^2$. The total light transmission rate of the phosphor film was 62%. However, since light was scattered largely, the right transmission light amount was low and thus the haze was 75% or more. There were many pin holes on the phosphor film, the film was poor in uniformity.

The MTF curve was formed in the same manner as in Example 10. The spatial resolution giving an MTF value of 30% was 181 p/mm.

The phosphor films formed in Example 10 and Comparative Example 2 were excited with an electron beam of 25 kV and 1 $\mu$A/cm$^2$ and the resultant brightness were compared. As a result, the brightness of the phosphor film of Example 10 had 85% of that of Comparative Example 2, posing no problem in putting into practical use.

Comparative Example 3

The same phosphor particles used in Example 10 were dispersed in water and allowed to settle to classify them, thereby preparing fine $Y_2O_3$:Eu phosphor particles having an average diameter of 0.9 $\mu$m.

Then, using the phosphor particles, a phosphor film was formed by the electron deposition method under the same conditions as in Example 10. Since the resultant phosphor film was thin, the electron deposition was carried out for further 15 minutes to obtain a phosphor film having a coating weight of 0.9 mg/cm$^2$. The resultant phosphor film had a total light transmission rate of 41%. However, since light was scattered largely in the same as Comparative Example 2, the phosphor film was non-transparent. In addition, protrusions were observed on the phosphor film at a ratio of 0.6 protrusions per cm$^2$.

The brightness and MTF of the phosphor film surface were determined in the same manner as in Example 10 and Comparative Example 2. As a result, the brightness was 87% of that of Comparative Example 2 and was the same level as that of Example 10. The spatial resolution giving an MTF value of 30% was 32 pl/mm, which was far from the value of Example 10.

EXAMPLE 11

ZnS:Tb phosphor particles containing Tb in an amount of 4 wt % and sulfur (5 wt % based on the phosphor) were supplied into the high frequency thermal plasma of 4 MHz and 15 kW in an argon atmosphere to vaporize them and then quenched rapidly to obtain ZnS:Tb phosphor powder containing fine particles. The resultant phosphor powder was dispersed in ethanol and allowed to settle, thereby classifying them. As a result, Zns:Tb fine phosphor particles having an average diameter of 40 nm were collected.

The phosphor film was formed in the same manner as in Example 10 except that a current was supplied for 3 minutes. The phosphor film thus obtained had a coating weight of 0.51 mg/cm$^2$, a haze of 10%. The transparency of the film was quite high. The light transmission rate of the film to white light was 78%.

The MTF curve was formed with respect to the phosphor film surface in the same manner as in Example 10. As a result, the spatial resolution giving an MTF value of 30% was 180 pl/mm, which was quite high value.

Comparative Example 4

ZnS:Tb phosphor particles containing Tb in an amount of 4 wt % were press molded to form a target. Using the ZnS:Tb target, RF sputtering was performed at 300 W for 15 minutes in a 2.5 Pa argon atmosphere, thereby obtaining a phosphor film having a coating weight of 0.49 mg/cm$^2$ on a glass substrate. Thereafter heat treatment was provided in vacuum at 550° C. for 5 hours.

The phosphor film thus obtained exhibited a haze of 5%, which meant that the transparency was a quite high. The total light transmission rate to white light was 80%. When measured in the same manner as in Example 10, the spatial resolution giving an MTF value of 30% was 220 pl/mm, which was quite excellent value.

As mentioned above, the phosphor of example 11 was quite excellent in transparency and resolution. In these respects, the phosphor obtained in Comparative Example 4 had the same results. However, as the brightness thereof was determined under the same conditions as in Example 10 and Comparative Example 2, the brightness of the phosphor in Comparative Example 4 was 60% of that of the phosphor in Example 12. The brightness was quite low.

Hereinbelow, we will describe Examples and Comparative Examples of the fluorescent lamps according to the present invention.

EXAMPLE 12, COMPARATIVE EXAMPLE 5

Raw material phosphor particles (calcium halophosphate phosphor) having an average diameter of about 7 $\mu$m, were molten by the high frequency thermal plasma process to vaporize partially and then rapidly quenched, thereby forming ultrafine phosphor particles and spherical phosphor particles, simultaneously. They were classified into ultrafine calcium halophosphate phosphor particles having an average diameter of 30 nm and spherical calcium halophosphate phosphor particles having an average diameter of 5 $\mu$m. The ratio of the ultrafine phosphor particles having diameters of at least 300 nm relative to the ultrafine phosphor particles, was 1 number % or less.

The calcium halophosphate ultrafine phosphor particles mentioned above were coated on the inner surface of a glass tube in a coating amount of 0.5 mg/cm$^2$. Subsequently, the spherical calcium halophosphate phosphor particles were coated thereon in an amount of 4.5 mg/cm$^2$. After a small amount of mercury and an Ar rare gas were sealed in the glass tube, bases including electrodes were provided. In such a general manner, a 40 W straight tube type fluorescent lamp of 32 mm in diameter was obtained. In the fluorescent lamp thus formed, there was no peeling off of the ultrafine phosphor particle film.

On the other hand, as Comparative Example 5 relative to the present invention, a 40 W straight type fluorescent lamp of 32 mm in diameter was prepared by coating calcium halophosphate phosphor particles having an average diameter of 7 $\mu$m directly on the inner surface of a glass tube in an coating amount of 4.5 mg/cm$^2$, sealing a small amount of mercury and an Ar rare gas in the tube, and providing bases.

As to the fluorescent lamps of Example 12 and Comparative Example 5, a lighting test was performed. The results are shown in Table 1. Note that the "lumen ratio" in Table 1 refers to a value relative to lumen (defined as 100) obtained at one hour after the initiation of lighting of the fluorescent lamp of Example 12.

TABLE 1

| | Lumen ratio (one hour after) |
|---|---|
| Example 12 | 100 |
| Comparative Example 5 | 60 |

As is apparent from Table 1, it is demonstrated that the fluorescent lamp of Example 12 is significantly improved in brightness in comparison with the lamp of Comparative Example 5 having no protecting film.

EXAMPLE 13

The raw material phosphor particles shown below were molten by the high frequency plasma heat method to vaporize partially and quenched, thereby manufacturing ultrafine phosphor particles, respectively.

The resultant $2(Sr_{0.98}Eu_{0.02}O).0.84P_2O_5.0.16B_2O_3$ ultrafine phosphor particles having an average diameter of 30 nm (46 parts by weight), $(Sr, Mg)_3(PO_4)_2$:Sn ultrafine phosphor particles having an average diameter of 20 nm (48 parts by weight), $Zn_2SiO_4$:Mn ultrafine phosphor particles having an average diameter of 20 nm (1 part by weight), and $Ca_{10}(PO_4)_6(F, Cl)_2$:Sb, Mn ultrafine phosphor particles having an average diameter of 30 nm (5 parts by weight) were mixed and suspended in butyl acetate. The suspension was coated on the inner surface of a glass tube in an amount of 0.5 mg/cm$^2$.

Then, the phosphor particles having an average diameter of about 3 $\mu$m before subjecting to the high frequency thermal plasma treatment were mixed and coated on the previously formed coating film, in an amount of 4.5 mg/cm$^2$. A small amount of mercury and an Ar rare gas were sealed in the glass tube and bases were provided to the tube. In this way, a 40 W straight type fluorescent lamp of 32 mm in diameter was formed and subjected to performance evaluation tests will be described later.

The obtained lamp is a high color rendering fluorescent lamp which has an average color rendering index (Ra) of 98 and a 5000 K color temperature. In the fluorescent lamp thus manufactured, there was no peeling off of the ultrafine phosphor particle film.

EXAMPLE 14

The raw material phosphor particles shown below were molten by the high frequency plasma heat method to vaporize partially and quenched, thereby manufacturing ultrafine phosphor particles, respectively.

The resultant $2(Sr_{0.98}Eu_{0.02}O).0.84P_2O_5.0.16B_2O_3$ ultrafine phosphor particles having an average diameter of 30 nm (46 parts by weight), $(Sr, Mg)_3(PO_4)_2$:Sn ultrafine phosphor particles having an average diameter of 20 nm (48 parts by weight), $Zn_2SiO_4$:Mn ultrafine phosphor particles having an average diameter of 20 nm (1 part by weight), and $Ca_{10}(PO_4)_6(F, Cl)_2$:Sb, Mn ultrafine phosphor particles having an average diameter of 30 nm (5 parts by weight) were mixed and suspended in butyl acetate. The suspension was coated on the inner surface of a glass tube in an amount of 0.5 mg/cm$^2$.

Then, the phosphor particles having an average diameter of about 3 $\mu$m before subjecting to the high frequency thermal plasma treatment were mixed and coated on the previously formed coating film in an amount of 3.0 mg/cm$^2$. A small amount of mercury and an Ar rare gas were sealed in the glass tube and bases were provided to the tube. In this way, a 40 W straight type fluorescent lamp of 32 mm in diameter was formed and subjected to performance evaluation tests will be described later.

The obtained lamp is a high color rendering fluorescent lamp which has an average color rendering index (Ra) of 98 and a 5000 K color temperature. In the fluorescent lamp thus manufactured, there was no peeling off of the ultrafine phosphor particle film.

Comparative Example 6

The phosphor particles used in Example 13 and having an average diameter of 3 $\mu$m were mixed and directly coated on the inner surface of a glass tube in an amount of 4.5 mg/cm$^2$. Thereafter, a small amount of mercury and an Ar rare gas were sealed in the glass tube and bases were provided to the tube. In this way, a 40 W straight type fluorescent lamp of 32 mm in diameter was manufactured.

The fluorescent lamps obtained in Examples 13 and 14 and Comparative Example 6 were subjected to a lighting test. The results are shown in Table 2. Note that the "lumen ratio" in Table 1 refers to a value relative to a lumen value (defined as 100) obtained at one hour after the initiation of lighting of the fluorescent lamp of Example 13.

TABLE 2

| | Lumen ratio | |
|---|---|---|
| | one hour after lighting | 5000 hours after lighting |
| Example 13 | 100 | 99 |
| Example 14 | 85 | 83 |
| Comparative Example 6 | 80 | 75 |

As is apparent from Table 2, the fluorescent lamp of Example 13 is brighter than that of Comparative Example 6 having no protection film and improved in light flux maintenance after long-time lighting. It is demonstrated that the fluorescent lamp of Example 14, which is formed by coating a lower amount of phosphors than that of Example 13, has an equivalent brightness to that of Comparative Example 6 having no protection film. It means that in an attempt to form the fluorescent lamp so as to have an equal brightness to that of Comparative Example 6 in accordance with the present invention, the amount of phosphors can be saved by near 30%. In other words, the cost of phosphors can be reduced by about 30%.

EXAMPLE 15, COMPARATIVE EXAMPLE 7

Raw material, $Y_2O_3$:Eu phosphor particles were molten by the high frequency thermal plasma process to vaporize partially and then quenched, thereby forming ultrafine phosphor particles and spherical phosphor particles, simultaneously.

The average diameters of ultrafine phosphor particles and spherical phosphor particles were about 40 nm and about 5 $\mu$m, respectively. The ultrafine phosphor particles were suspended in a mixed solvent of butyl acetate and nitrocellulose. The suspension was coated on the inner surface of a glass tube in a coating amount of 0.5 mg/cm$^2$.

Then, the spherical phosphor particles were coated on the ultrafine phosphor particle film in an coating amount of 4.0 mg/cm$^2$. After a small amount of mercury and an Ar rare gas were sealed in the glass tube and bases (including electrodes) were provided to the tube. In this manner, a 40 W straight tube fluorescent lamp of 32 mm in diameter was obtained.

On the other hand, as Comparative Example 7 to the present invention, a 40 W straight type fluorescent lamp of 32 mm in diameter was prepared by coating $Y_2O_3$:Eu phosphor particles (4.5 $\mu$m average diameter) used in Example 15 directly on the inner surface of a glass tube in an coating amount of 4.0 mg/cm$^2$, sealing a small amount of mercury and an Ar rare gas into a tube, and providing bases to the tube.

As to the fluorescent lamps of Example 15 and Comparative Example 7, a lighting test was performed. The results are shown in Table 3.

TABLE 3

| | Lumen ratio (one hour later) |
|---|---|
| Example 15 | 100 |
| Comparative Example 7 | 75 |

As is apparent from Table 3, it is demonstrated that the fluorescent lamp of Example 15 is brighter than that of Comparative Example 7 which uses neither ultrafine phosphor particles nor spherical phosphor particles.

EXAMPLE 16 AND COMPARATIVE EXAMPLE 8

Raw material, $Y_2O_3$:Eu phosphor particles were molten by the high frequency thermal plasma process to vaporize partially and then quenched, thereby forming ultrafine phosphor particles. The average diameter of the ultrafine phosphor particles was about 30 nm. The ultrafine phosphor particles were suspended in a nitrocellulose (1 wt %)+butyl acetate solution. The suspension was coated on the inner surface of a glass tube in a coating amount of 0.5 mg/cm$^2$.

Then, a $Y_2O_3$:Eu phosphor, $LaPO_2$:Ce Tb phosphor, $(Sr, Ca)_5(PO_4)_3Cl$:Eu phosphor, $(Ba, Ca, Mg)_5(PO_4)Cl$:Eu phosphor, and Mf-fluorogermanate:Mn phosphor were mixed and coated on the aforementioned coating film of the ultrafine phosphor particles in a coating amount of 4.0 mg/cm$^2$.

After a small amount of mercury and an Ar rare gas were sealed in the glass tube and bases (including electrodes) were provided to the tube. In this manner, a 40 W straight tube fluorescent lamp of 32 mm in diameter was obtained.

On the other hand, as Comparative Example 8 to the present invention, a 40 W straight type fluorescent lamp of 32 mm in diameter was prepared by coating the mixed phosphor particles (5 $\mu$m average diameter) used in Example 16 directly on the inner surface of a glass tube in an coating amount of 4.0 mg/cm$^2$, sealing a small amount of mercury and an Ar rare gas in the tube, and providing bases to the tube.

As to the fluorescent lamps of Example 16 and Comparative Example 8, a lighting test was performed. The results are shown in Table 4.

TABLE 4

| | Lumen ratio | |
|---|---|---|
| | one hour after lighting | 5000 hours after lighting |
| Example 16 | 100 | 95 |
| Comparative Example 8 | 95 | 75 |

EXAMPLE 17 AND COMPARATIVE EXAMPLE 9

Raw material, $Y_2O_3$:Eu phosphor particles were molten by the high frequency thermal plasma process to vaporize partially and then quenched, thereby forming ultrafine phosphor particles. The average diameter of the ultrafine phosphor particles was about 30 nm. The ultrafine phosphor particles were suspended in a nitrocellulose (1 wt %)+butyl acetate solution. The suspension was coated on the inner surface of a glass tube in a coating amount of 0.5 mg/cm$^2$.

Then, phosphors, $Y_2O_3$:Eu; $GdMgB_5O_{10}$:Ce, Tb; $BaMg_2Al_{16}O_{27}$:Eu; (Ba, Ca, Mg)$_5$($PO_4$)Cl:Eu; and Mf-fluorogermanate:Mn were mixed and coated on the aforementioned coating film of the ultrafine phosphor particles in a coating amount of 4.0 mg/cm$^2$.

After a small amount of mercury and an Ar rare gas were sealed in the glass tube, bases (including electrodes) were provided to the tube. In this manner, a fluorescent lamp of 210 mm long and 16 mm diameter was obtained with a buld wall loading of 2050 W/m$^2$.

On the other hand, as Comparative Example 9 to the present invention, a fluorescent lamp of 210 mm long and 16 mm diameter was prepared with a buld wall loading of 2050 W/m$^2$ by coating the mixed phosphor particles (5 $\mu$m average diameter) used in Example 17 directly on the inner surface of a glass tube in an coating amount of 4.0 mg/cm$^2$, sealing a small amount of mercury and an Ar rare gas, and providing bases to the tube.

As to the fluorescent lamps of Example 17 and Comparative Example 9, a lighting test was performed. The results are shown in Table 5.

TABLE 5

| | Lumen ratio | |
|---|---|---|
| | one hour lighting | 5000 hours after lighting |
| Example 17 | 100 | 90 |
| Comparative Example 9 | 95 | 65 |

Hereinbelow, we will describe Examples and Comparative Examples of the ultraviolet-suppressed light source of the present invention.

EXAMPLE 18

Tetraethoxysilane (100 parts by weight), isopropyl alcohol (100 parts by weight), and 0.1N hydrochloric acid (35 part by weight) were mixed and allowed to react with stirring for 2 hours at 80° C. After tetraethoxysilane was hydrolyzed, isopropyl alcohol (245 parts by weight) was added, thereby preparing a tetraethoxysilane hydrolyzed solution, which was used as a binder solution. To the binder solution (100 parts by weight), transparent phosphor particles having an average diameter of 50 nm, which were obtained by vaporizing (Sr, Mg)$_2$($PO_4$)$_2$:$Sn^{2+}$phosphor by the high frequency thermal plasma process and quenching, were added in an amount of 5 parts by weight. Subsequently, the mixture was dispersed for 100 hours in a ball mill, thereby preparing a coating agent. The coating agent was sprayed and coated on the outer surface of a glass tube of a commercially available fluorescent lamp (FL20S N-SDL, manufactured by Kabushiki Kaisha Toshiba Lightech). The resultant film was dried at 10° C. for 10 minutes to form a transparent film of 2 $\mu$m thick.

EXAMPLE 19

A mixture was made of 100 parts by weight of silicone vanish (non-volatile content: 50%) and 50 parts by weight of transparent phosphor particles having an average diameter of 30 nm obtained by vaporizing a 3.5MgO.0.5$MgF_2$.$GeO_2$:$Mn^{4+}$ phosphor by the high frequency thermal plasma process and quenching them. The phosphor particles of the mixture were dispersed by a sand grinder for 30 minutes. To the resultant mixture, isocianate (20 pats by weight) was added as a curing agent to prepare a coating agent. The curing agent was sprayed and coated on the outer surface of a glass substrate of a fluorescent lamp constructed in the manner as in Example 1. The film obtained was dried at 60° C. for 30 minutes to form a transparent film of 5 $\mu$m thick.

Comparative Example 10

The same fluorescent lamp (Fl20S, N-SDL) as used in Example 18 was prepared except that no film coating was provided either onto the inner surface or the outer surface of a glass tube.

Comparative Example 11

A commercially available fluorescent lamp (L-EDL type, manufactured by kabushiki Kaisha Toshiba Laitech) was prepared with no film coating either on the inner surface or the outer surface of a glass tube.

Comparative Example 12

A fluorescent lamp with an ultraviolet absorbing film was prepared in the same manner as in Example 18 except that a coating agent containing zinc oxide (2.5 parts by weight) and titanium oxide (2.5 parts by weight) having an average diameter of 30 nm was used instead of transparent phosphor particles.

The characteristics of fluorescent lamps of Examples 18 and 19 and Comparative Examples 10–12 are shown in FIG. 6. In FIG. 6, "R9" indicates a color rendering index specific to a red color having a high chromaticness and "UV" denotes an ultraviolet radiation amount. The ultraviolet radiation amount was determined by means of an ultraviolet radiation intensity meter (UVR-365, manufactured by Tokyo Kogaku) and by setting the distance between a lamp and a light receiving portion to 30 cm. Mark "–" of the "UV" column indicates that no ultraviolet rays were detected by the ultraviolet intensity meter.

As is apparent from Table 6, the fluorescent lamps of Example 18 and 19 are almost equal in total luminous flux, compared to a fluorescent lamp with no coating film (Comparative Example 10). The fact that an ultraviolet ray of 365 nm was not detected the fluorescent lamps of Examples 18 and 19 demonstrated that the lamps were good in color fade suppressing effect. Although the lamps of Examples 18 and 19 exhibit the same brightness as that of Comparative Example 10, they differ in the emission color. To be more specific, the lamp of Example 18 emits a red color in the wide range around 620 nm, contributing to an improvement of R9. On the other hand, the fluorescent lamp of Example 19, which differs in the emission color from that of Comparative Example 10, emits a deep red color around 660 nm, thereby improving R9. The lamp of Comparative Example 11 is suitable for rendering a red color of museums exhibits to be seen natural, however the brightness thereof is low. Unlike Comparative Example 11, lamps prepared by Examples provide bright light and efficiently act as a color rendering lamp which can render human skin colors and a blood color quite fine. On the other hand, the fluorescent lamps having an ultraviolet absorbing coating film which contains zinc oxide and titanium oxide have an ultraviolet suppressing effect. However, no improvement is observed in color rendering properties thereof.

TABLE 6

| | R9 | Total luminous flux (1 m/W) | UV ($\mu$W/cm$^2$) |
|---|---|---|---|
| Example 18 | 79 | 56 | — |
| Example 19 | 80 | 57 | — |
| Comparative Example 10 | 72 | 55 | 15.5 |
| Comparative Example 11 | 80 | 49 | 15.0 |
| Comparative Example 12 | 69 | 53 | — |

Hereinbelow we will describe Examples and Comparative Examples of the transparent luminous base material and the luminous panel of the present invention.

EXAMPLE 20 AND COMPARATIVE EXAMPLE 13

A commercially available long persistent inorganic $SrAl_2O_4$:Eu series phosphor was used as a raw material. The $SrAl_2O_4$:Eu series phosphor was supplied into a high frequency thermal plasma using a mixed gas of argon and oxygen as a carrier. After vaporized, the phosphor were rapidly quenched to form ultrafine phosphor particles. The ultrafine phosphor particles were classified and particles of at least 100 nm were removed. The ultrafine particles of a long persistent inorganic phosphor thus obtained had an average diameter of 50 nm and contain particles of at least 100 nm in an amount of 5 number % or less. The ultrafine particles of a long persistent inorganic phosphor were added in an amount of 0.5 wt % to a glass raw material. From the glass raw material, a glass window of 2 m long×1 m wide was formed.

On the other hand, as Comparative Example 13 to the present invention, a glass window of the same size was formed by adding a commercially available long persistent inorganic $SrAl_2O_4$:Eu series phosphor (average diameter: 15 $\mu$m) used in Example 20 to a glass raw material in an amount of 0.5 wt %.

The glass windows of Example 20 and Comparative Example 13 were fixed in window frames next to each other, in an experimental building house. The transparency of the windows were compared between the daytime and the nighttime by placing mannequin (a window dummy) inside the building house at the inner side of the window. When the mannequin was observed by the naked eye in the dark of the nighttime, the window emitted a slightly green light in both cases. When observed in the light of the daytime, the mannequin was seen well through the window of Example 20, whereas the mannequin was blurred through the window of Comparative Example 13, since light was scattered.

EXAMPLE 21 AND COMPARATIVE EXAMPLE 14

Super fine particles of the long persistent inorganic $SrAl_2O_4$:Eu series phosphor prepared in Example 20, was added in an amount of 1 wt % to a transparent binder. In this way, transparent luminous ink was prepared. After letters were written on normal white paper with generally used ink, a further writing was added with the transparent luminous ink.

On the other hand, as Comparative Example 14 to the present invention, ultrafine phosphor particles were prepared by supplying a raw material, commercially available $Y_2O_3$:Eu phosphor, which is not a long persistent inorganic phosphor, to a high frequency thermal plasma using a mixed gas of argon and oxygen as a carrier and rapidly quenching. The ultrafine particles of at least 100 nm were removed by classification. The resultant ultrafine phosphor particles were added to a transparent binder in an amount of 1 wt %, thereby preparing transparent luminous ink. The writing was prepared in the same manner as in Example 21 by using the luminous ink and blue ink.

When the writings of Example 21 and Comparative Example 14 were compared under a generally used fluorescent lamp, difference between them was not particularly observed. Letters written with blue ink was readable clearly in both cases. On the other hand, in the dark in which the fluorescent lamp was turned off, the writing of Example 21 was readable since letters written with luminous ink emitted green light, whereas the writing of Comparative Example 14 was not read until black light was used. Since black light is not commonly seen in ordinary homes, the luminous ink of Comparative Example 14 is not suitable for practical use. The same results were obtained when a billboards and signboards were written with the luminous inks of Example 21 and Comparative Example 14. The luminous ink emitted light over 12 hours. This fact demonstrates that the luminous properties effectively lasted throughout the nighttime. Likewise, the use of the ultrafine particles of long persistent inorganic phosphor makes it possible to save electric power and labor.

Additional advantages and modifications will readily occur to those skilled in the art. Therefore, the invention in its broader aspects is not limited to the specific details, and representative devices shown and described herein. Accordingly, various modifications may be made without departing from the spirit or scope of the general inventive concept as defined by the appended claims and their equivalents.

What is claimed is:

1. A fluorescent lamp, comprising:

a glass tube in which an ionizable medium containing mercury is sealed;

an undercoat layer formed on an inner surface of said glass tube, said layer comprising ultrafine phosphor particles having an average diameter of 200 nm or less and which are obtained by heating a phosphor material, which vaporizes the material, and rapidly quenching the material to solidify the phosphor material;

a luminous layer comprising spherical phosphor particles having an average diameter of at least one 1 $\mu$m, which are prepared by a thermal plasma treatment; and electrodes provided on both ends of the glass tube; wherein the hase value of the transmitted visible light from the lamp is no more than 50%.

2. The fluorescent lamp according to claim 1, wherein the undercoat layer has a thickness ranging 100 nm to 100 $\mu$m.

3. The fluorescent lamp according to claim 2, wherein said thickness ranges from 1–3 $\mu$m.

4. The fluorescent lamp according to claim 1, wherein said ultrafine phosphor particles have an average diameter of 150 nm or less.

5. The fluorescent lamp according to claim 4, wherein the ultrafine phosphor particles have an average diameter ranging from 10–50 nm.

6. The fluorescent lamp according to claim 1, wherein the ultrafine phosphor particles of the undercoat layer are present in an amount ranging from 5–500 $\mu$g/cm$^2$.

7. The fluorescent lamp according to claim 6, wherein said amount of ultrafine phosphor particles ranges from 5–50 $\mu$g/cm$^2$.

8. The fluorescent lamp according to claim 1, wherein the phosphor particles of said luminous layer are spherical particles having an average diameter ranging from 1–10 μm.

9. The fluorescent lamp according to claim 8, wherein said average diameter ranges from 1–10 μm.

10. The fluorescent lamp according to claim 1, wherein an ultraviolet suppressing layer is positioned between said undercoat layer and said luminous layer.

11. The fluorescent lamp according to claim 10, wherein said luminous layer has a thickness ranging from 0.1–100 μm.

12. The fluorescent lamp according to claim 11, wherein said suppressing layer has a thickness ranging from 0.5–30 μm.

13. The fluorescent lamp according to claim 1, wherein the number of ultrafine particles having an average diameter of 300 nm is less than 5%.

14. The fluorescent lamp according to claim 1, wherein said ultrafine phosphor particles have at least one common composition as those constituting said luminous layer.

* * * * *